US005625696A

United States Patent [19]

Fosgate

[11] Patent Number: 5,625,696

[45] **Date of Patent: *Apr. 29, 1997**

[54] SIX-AXIS SURROUND SOUND PROCESSOR WITH IMPROVED MATRIX AND CANCELLATION CONTROL

[75] Inventor: James W. Fosgate, Heber City, Utah

[73] Assignee: Harman International Industries, Inc., Northridge, Calif.

[ * ] Notice: The term of this patent shall not extend beyond the expiration date of Pat. No. 5,504,819.

[21] Appl. No.: 631,603

[22] Filed: Apr. 2, 1996

Related U.S. Application Data

[63] Continuation-in-part of Ser. No. 624,907, Mar. 27, 1996, which is a continuation of Ser. No. 276,901, Jul. 18, 1994, Pat. No. 5,504,819, which is a continuation-in-part of Ser. No. 990,660, Dec. 14, 1992, Pat. No. 5,428,687, which is a continuation-in-part of Ser. No. 533,091, Jun. 8, 1990, Pat. No. 5,172,415.

[51] Int. Cl.[6] ..... H04R 5/00

[52] U.S. Cl. ..... 381/18; 381/22

[58] Field of Search ..... 381/18, 17, 19, 381/20, 21, 22, 23

[56] References Cited

U.S. PATENT DOCUMENTS

| | | | |
|---|---|---|---|
| 3,982,071 | 9/1976 | Weiss et al. . | |
| 3,989,903 | 11/1976 | Cooper et al. . | |
| 5,216,718 | 6/1993 | Fukuda | 381/18 |
| 5,504,819 | 4/1996 | Fosgate | 381/18 |

*Primary Examiner*—Minsun Oh
*Attorney, Agent, or Firm*—Haynes and Boone, L.L.P.

[57] ABSTRACT

A surround sound processor for redistribution of stereophonic audio signals into multiple channels for presentation on a plurality of loudspeakers surrounding a listener has an improved direction detector filter circuit, a peak hold circuit in the direction detector for better dynamic separation, improved time constants in the servologic circuit, improved linearity correction in the control voltage generator to match the characteristics of the new voltage controlled amplifiers which are applied to the separation matrix, a separation matrix having cancellation of unwanted signals wihtout gain modification for desired signal components, and improved shelf filters in the rear channel outputs.

8 Claims, 9 Drawing Sheets

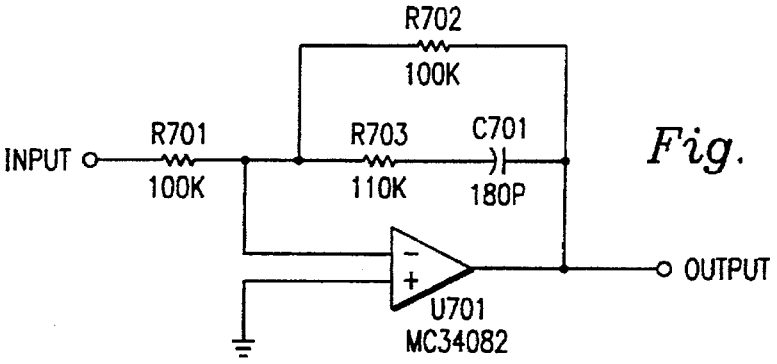
*Fig. 7*
*Fig. 8*
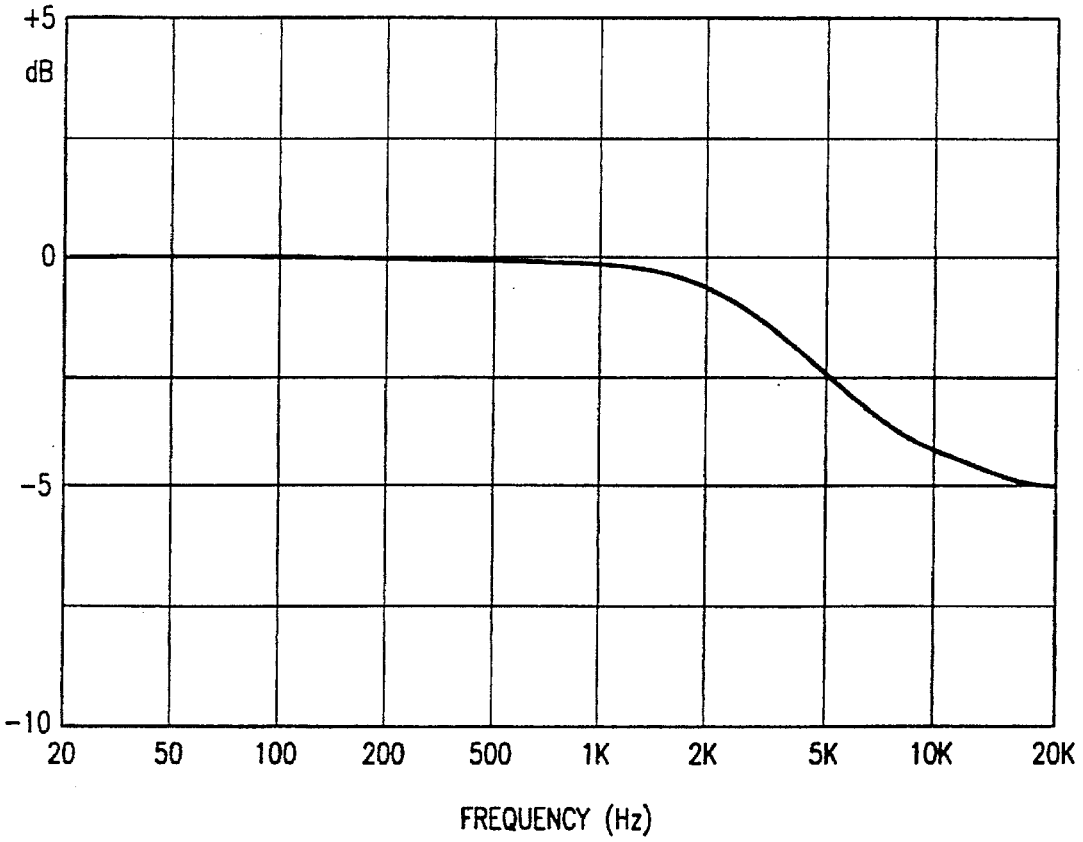

SIX-AXIS SURROUND SOUND PROCESSOR WITH IMPROVED MATRIX AND CANCELLATION CONTROL

CROSS REFERENCE TO RELATED APPLICATIONS

This application is a continuation-in-part of copending U.S. patent application Ser. No. 08/624,907, filed Mar. 27, 1996, herein incorporated fuly by reference, which is a continuation of U.S. patent application Ser. No. 08/276,901, entitled "Surround Sound Processor with Improved Control Voltage Generator," filed Jul. 18, 1994, issuing as U.S. Pat. No. 5,504,819 on Apr. 2, 1996, which is a continuation-in-part of U.S. Pat. No. 5,428,687, issued on Jun. 27, 1995 from U.S. patent application Ser. No. 07/990,660, filed Dec. 14, 1992 entitled "Control Voltage Generator Multiplier and One-Shot for Integrated Surround Sound Processor," which is a continuation-in-part of U.S. Pat. No. 5,172,415, issued on Dec. 15, 1992 from U.S. patent application Ser. No. 07/533,091, filed Jun. 8, 1990.

BACKGROUND OF THE INVENTION

The present invention relates in general to processors for the periphonic reproduction of Sound. More specifically, the invention relates to improvements in the detector filter, separation matrix, low frequency center front cancellation circuit, servologic control voltage generator, voltage controlled amplifiers, and output shelf filter circuits of a surround sound processor for multichannel redistribution of audio signals.

A surround sound processor operates to enhance a two-channel stereophonic source signal so as to drive a multiplicity of loudspeakers arranged to surround the listener, in a manner to provide a high-definition soundfield directly comparable to discrete multitrack sources in perceived performance. An illusion of space may thus be created enabling the listener to experience the fullness, directional quality and aural dimension or "spaciousness" of the original sound environment. The foregoing so-called periphonic reproduction of sound can distinguished from the operation of conventional soundfield processors which rely on digitally generated time delay of audio signals to simulate reverberation or "ambience" associated with live sound events. These conventional systems do not directionally localize sounds based on information from the original performance space and the resulting reverberation characteristics are noticeably artificial.

To accomplish this end, a surround sound processor typically comprises an input matrix, a control voltage generator and a variable matrix circuit.

The input matrix usually provides for balance and level control of the input signals, generates normal and inverted polarity versions of the input signals, plus sum and difference signals, and in some cases generates phase-shifted versions, and/or filters the signals into multiple frequency ranges as needed by the remainder of the processing requirements.

The control voltage generator includes a directional detector and a servologic circuit. The directional detector measures the correlations between the signals which represent sounds encoded at different directions in the stereophonic sound stage, generating voltages corresponding to the predominant sound location. The servologic circuit uses these signals to develop control voltages for varying the gain of voltage-controlled amplifiers in the variable matrix circuit in accordance with the sound direction and the direction in which it is intended to reproduce the sound in the surrounding loudspeakers.

The variable matrix circuit includes voltage-controlled amplifiers and a separation matrix. The voltage-controlled amplifiers amplify the input matrix audio signals with variable gain, for application to the separation matrix, where they are used to selectively cancel crosstalk into different loudspeaker feed signals. The separation matrix combines the outputs of the input matrix and of the voltage-controlled amplifiers in several different ways, each resulting in a loudspeaker feed signal, for a loudspeaker to be positioned in one of several different locations surrounding the listener. In each of these signals, certain signal components may dynamically eliminated by the action of the detector, control voltage generator, voltage-controlled amplifiers (VCA's) and separation matrix.

In surround sound processors, much of the subtleties of the presentation are due to the characteristics of direction detector and servologic circuit of the control voltage generator and of the VCA's. As these are further refined, the apparent performance becomes more transparent and effortless-sounding to the listener.

SUMMARY OF THE INVENTION

The present invention provides an improved surround processor for the reproduction of sound from a stereophonic source in a manner comparable to a live presentation from multiple sources in performances. The present invention relates in particular to improvements in implementation of several portions of the surround sound processor circuitry, including improvements in the implementation of the circuitry of the direction detector, separation matrix circuitry, center front bass cancellation circuit, servologic control voltage generator employing multiple-axis control voltage signals, voltage controlled amplifiers, and output shelf filter circuits of surround sound processor.

In one embodiment, the invention comprises a surround sound processor including audio input terminals for receiving a left and a right audio input signal forming a conventional stereophonic audio signal pair; an input stage for buffering and balancing the left and right audio input signals and providing output left and right audio signals; a detector filter circuit receiving the output left and right audio signals and having a band pass characteristic, followed by an inverter circuit and a detector matrix circuit to provide left and right audio signal currents; a direction detector circuit receiving the left and right audio signal currents and providing therefrom left-right and front-back directional signals, and including peak hold circuitry; a detector splitter circuit providing left front-right front, left back-right back, and front-back output signals derived from the outputs of the direction detector circuit, and incorporating linearity correction circuitry; a servologic circuit providing variable time constant smoothing of the output signals from the detector splitter circuit, and producing six output control signals; voltage controlled amplifier circuits, each controlled by a different one of the six output control signals of the servologic circuit, and each provided with input audio signals that are a combination of the left and right output audio signals from the input stage, each of such voltage controlled amplifier circuits being provided with an inverter circuit so as to produce controlled audio signals of both normal and inverted polarity; a separation matrix circuit for combining the output left and right audio signals from the input stage with one or more of the output signals from the voltage controlled amplifier circuits in various appropriate proportions so as to provide a plurality of matrix output signals; and a like plurality of output buffer amplifiers for buffering and level control of the matrix output signals to produce at a like plurality of output terminals a set of loudspeaker feed signals for amplification and application to loudspeakers placed in a listening area so as to surround a listener.

A technical advantage achieved with the invention is a surround processor which provides faster but smoother and more realistic multichannel sound redistribution from a stereophonic source.

Another advantage achieved is an improved aural performance in terms of reduced artifacts and anomalies in the redistribution of stereophonic sound into a multichannel soundfield.

BRIEF DESCRIPTION OF THE DRAWINGS

FIG. 7 is a detailed schematic of an output shelf filter employed in the processor of FIG. 1; and FIG. 8 is a graph of the frequency response of the shelf filter circuit of FIG. 8.

DETAILED DESCRIPTION OF THE INVENTION

The principal new features of the present invention are an improved detector filter circuit providing a better match between the detector performance and the audibility of concurrent sounds in different frequency ranges; an improved separation matrix circuit resulting in reduced artifacts and anomalies in the perceived performance; improved bass cancellation circuitry to remove bass from the center front loudspeaker; improvements to the component values of the control voltage generator circuitry to attain faster and smoother performance characteristics; new VCA circuitry with improved characteristics over the type previously used; and new output shelf filter circuitry for better spatial representation in certain surround sound modes of operation.

Figure 1:
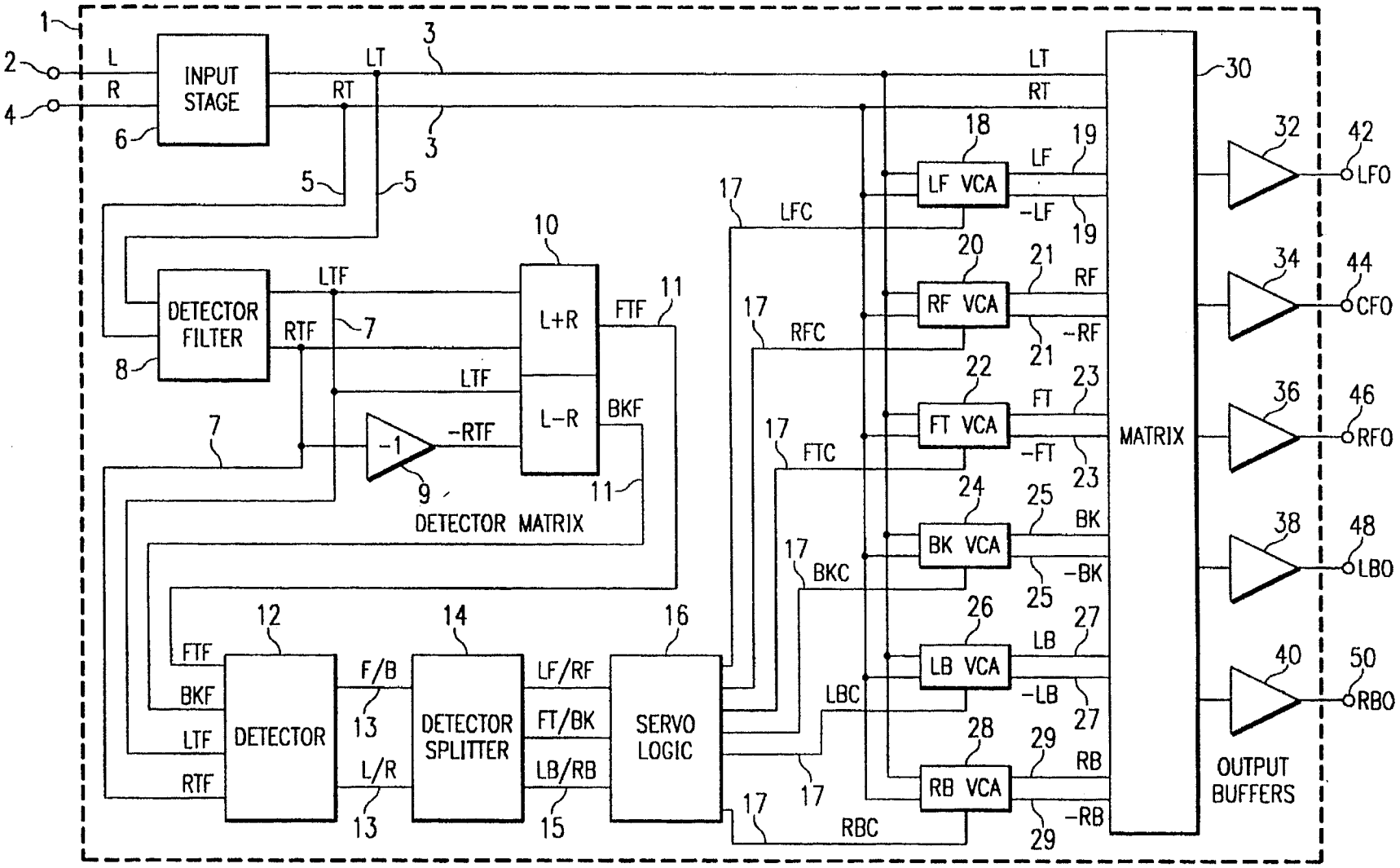
FIG. 1 is a block schematic of a six-axis surround sound processor according to the invention.

In the present invention, based on experience with the circuitry of the processor of FIG. 1, further improvements have been made in the detector filter circuitry. It has been found that gain-riding circuitry in the separation matrix is no longer needed and better aural performance is obtained with some changes in the separation matrix coefficients. Previous center front bass cancellation circuitry has also been improved to provide better reduction in bass output in the center front channel, which is typically applied to smaller loudspeakers having lower bass power handling capacity. Furthermore, the time constants in the control voltage generator circuitry have been adjusted to faster values in order to improve dynamic separation and attain a faster response. Previous VCA circuits employed junction field-effect transistors for gain control, but the present invention includes an improved VCA circuit based on an integrated circuit voltage controlled amplifier. To improve the sense of spaciousness and depth in rear channel sounds, shelf filters have been provided with improved frequency response characteristics, for use in certain modes of sound reproduction. To understand these improvements more fully, the preferred embodiments of the invention will be described in detail below.

In FIG. 1, the surround sound processor 1 is equipped with input terminals 2, 4, for receiving left (L) and right (R) audio input signals respectively. These signals are processed by an input stage, 6, typically containing auto-balancing circuitry and other signal conditioning circuits, such as level controls and possibly a panorama control. The output signals from this stage are labeled LT and RT, and are applied via lines 5 to a detector filter 8, and via lines 3 to VCA's 18–28 and an separation matrix 30. Although not shown, to simplify the drawing for improved clarity, the inversions of these signals, –LT and –RT may be generated here and also provided via lines 3 to the VCA's 18–28 and separation matrix 30.

The detector filter 8 provides filtered signals LTF and RTF labeled 7 to the inverter 9, the detector matrix circuit 10 and to a detector circuit 12. The signal RTF is inverted by the inverter 9 and also applied to the detector matrix circuit 10. The detector matrix 10 generates outputs 11 labeled FTF and BKF corresponding to front (L+R) and back (L–R) signal directions. These signals are also applied to detector circuit 12, which comprises two identical circuits. One accepts input signals FTF and BKF and produces an output signal F/B at 13, while the other accepts the input signals LTF and RTF to produce an output signal L/R at 13.

The detector output signals 13 labeled F/B and L/R are applied to the detector splitter circuit 14, wherein are produced the three signals 15 labeled LF/RF, FT/BK and LB/RB. These in turn are applied to the servo logic circuit 16 to provide six control voltage signals 17 labeled LFC, FRC, FTC, BKC, LBC and RBC, for controlling the six VCA's 18 and 28, and labeled LF, RF, FT, BK, LB, and RB VCA respectively.

These VCA's receive the LT and RT signals 3 in different proportions, according to the directional matrix they are intended to provide, and apply their output signals 19 through 29 each in both polarities to the separation matrix 30, which also receives the unmodified LT and RT signals 3. As mentioned above, though not shown in FIG. 1, inverters may also be provided for these signals LT and RT to generate –LT and –RT respectively. These inverters may be considered to be a part of the input stage, as their outputs may also be applied to some inputs of VCA's 18 through 28. These details are shown in the accompanying FIGS. 2–8, as necessary for the understanding of the invention, but are not included in FIG. 1 in order to simplify the diagram and improve clarity.

Outputs from the matrix 30 are passed through variable attenuators 31 through 39 and buffered by amplifiers 32 through 40, providing output signals LFO, CFO, RFO, LBO and RBO at terminals 42, 44, 46, 48 and 50 respectively. These form the five standard outputs of the processor 1, but other outputs (not shown) may also be provided. Typically, the outputs shown may be provided to electronic crossover components in order to provide subwoofer outputs L-SUB, R-SUB and M-SUB (not shown in FIG. 1) as well as the five outputs shown. Such techniques are well known in the art and need no further explanation here.

Figure 2:
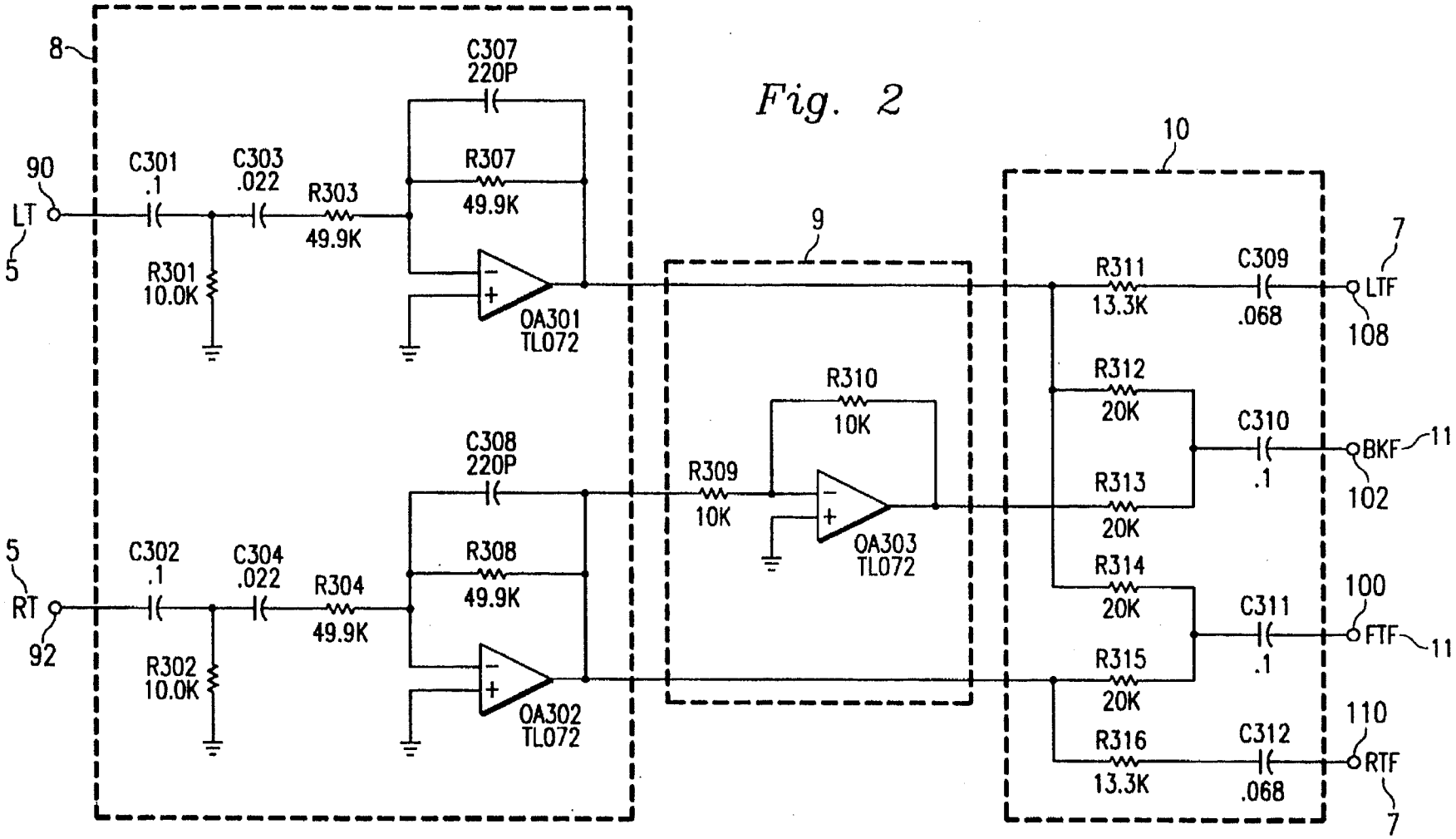
FIG. 2 is a detailed schematic of an improved detector filter circuit employed in the processor of FIG. 1.

Referring to FIG. 2, there is shown an improved detector filter circuit. Previous detector filters used in similar processors which are the subject of related Patent Applications referenced above employed an inverse Fletcher-Munson curve, which approximates the sensitivity of the ear particularly at low levels. Experience has shown that there was too much crosstalk, or too little separation, below 1 kHz, and the modified circuit responds better to these lower frequencies.

Figure 4:
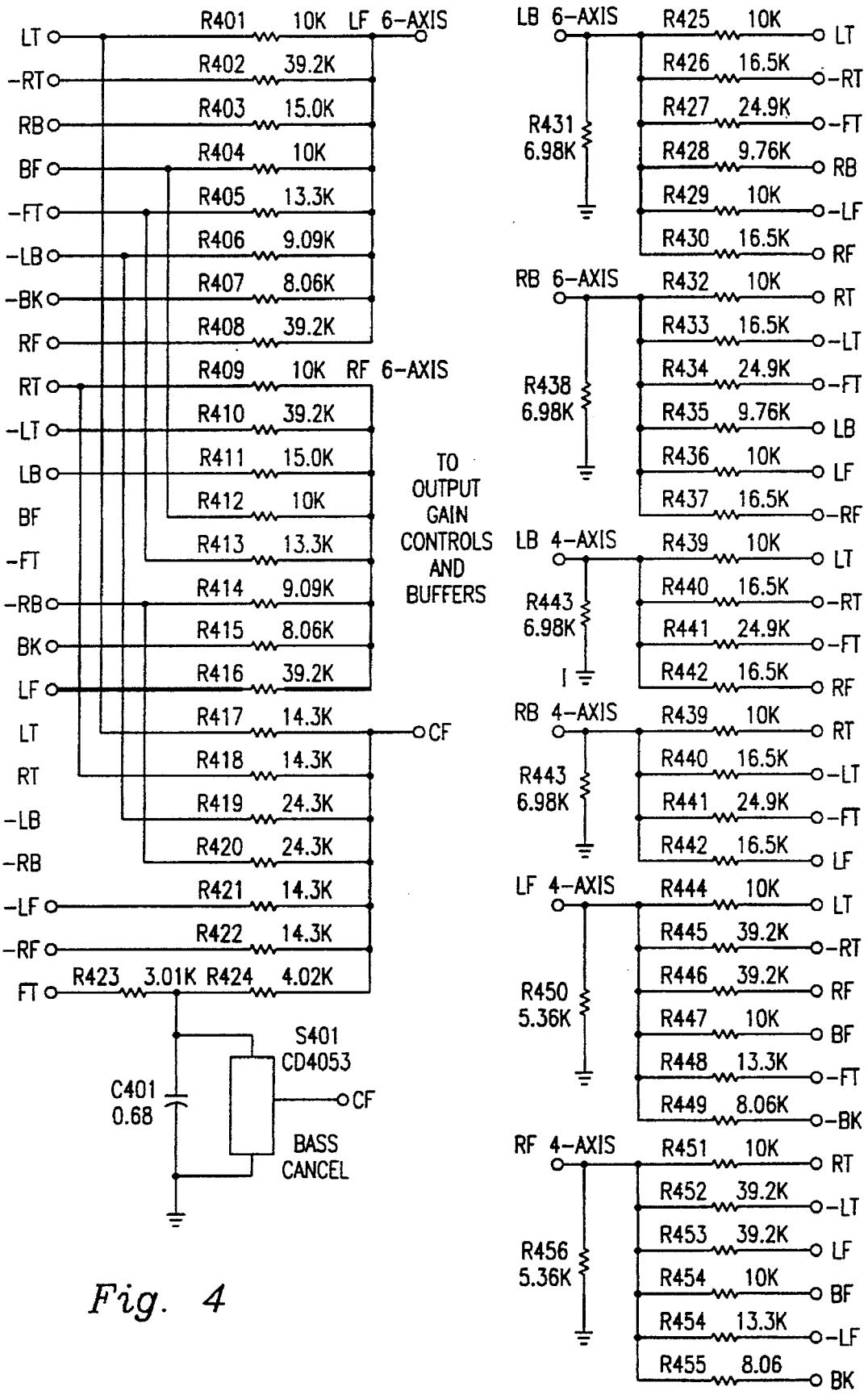
FIGS. 4 is a detailed schematic of the separation matrix circuitry of the processor of FIG. 1, including center front bass cancellation circuitry.

In FIG. 2, which corresponds with FIG. 4 of the co-pending application, there is shown a detector filter 8, inverter 9, and detector matrix 10. Input terminals 90 and 92 are provided for receiving the signals 5 labeled LT and RT respectively. These signals 5 are filtered by the detector filter first stage 8 comprising operational amplifier OA301 and its associated components for the signal LT, and op-amp OA302 with its associated components for the signal RT. Other outputs of this filter stage 8 are passed to the inverter 9 and to the detector matrix 10. The right channel filter output is inverted by inverter 9 which comprises op-amp OA303 with input resistor R309 and feedback resistor R310, with typical values shown. The output of op-amp OA301 is fed via resistor R311 and capacitor C309 in series to output terminal 108, providing a filtered current signal LTF. The output of op-amp OA302 is fed via resistor R316 and capacitor C317 to output terminal 110 providing the filtered current signal RTF. The outputs of both op-amps OA301 and OA302 are combined via resistors R314 and R315 and capacitor C311 to provide the filtered current signal FTF at output terminal 100, and the outputs of op-amps OA301 and OA303 are combined via resistors R312 and R313 and capacitor C310 to provide the filtered current signal BKF at output terminal 102.

This circuit is similar to detector filters disclosed in Fosgate's earlier patents and patent applications, cited above, but the components formerly shown in FIG. 4 of the co-pending application Ser. No. 08/276,902, labeled C305, R305, C306 and R306, have been removed from the circuit. Additionally, capacitors C303 and C304 have been changed from 0.01 uF to 0.022 uF and resistors R303, R304, R307 and R308 have changed to 49.9 k ohms from 200 k ohms and 110 k ohms. These changes effect the alteration in frequency response from an inverse Fletcher-Munson curve to a bandpass filter without the boosted response in the upper midrange region.

Additionally, resistors R309, and R310 in the inverter circuit 9 have changed from 24.9 k ohms to 10 k ohms, without changing the inverter function or gain.

In the final stage 10 the resistors R312 through R316 have changed from 4.02 kohms to 20 kohms, and capacitors C310 and C311 changed from 0.47 uF to 0.1 uF. Resistors R311 and R316 changed from 2.00 k ohms to 13.3 k ohms and capacitors C309 and C312 changed from 0.47 uF to 0.068 uF. In all cases the time constants are approximately the same as previously, but the sensitivity of the left-right detector has been reduced by almost 3 dB relative to the sensitivity of the front-back detector. These changes tend to lock in dialog better than previously, since dialog is often placed in the center front channel.

Figure 3:
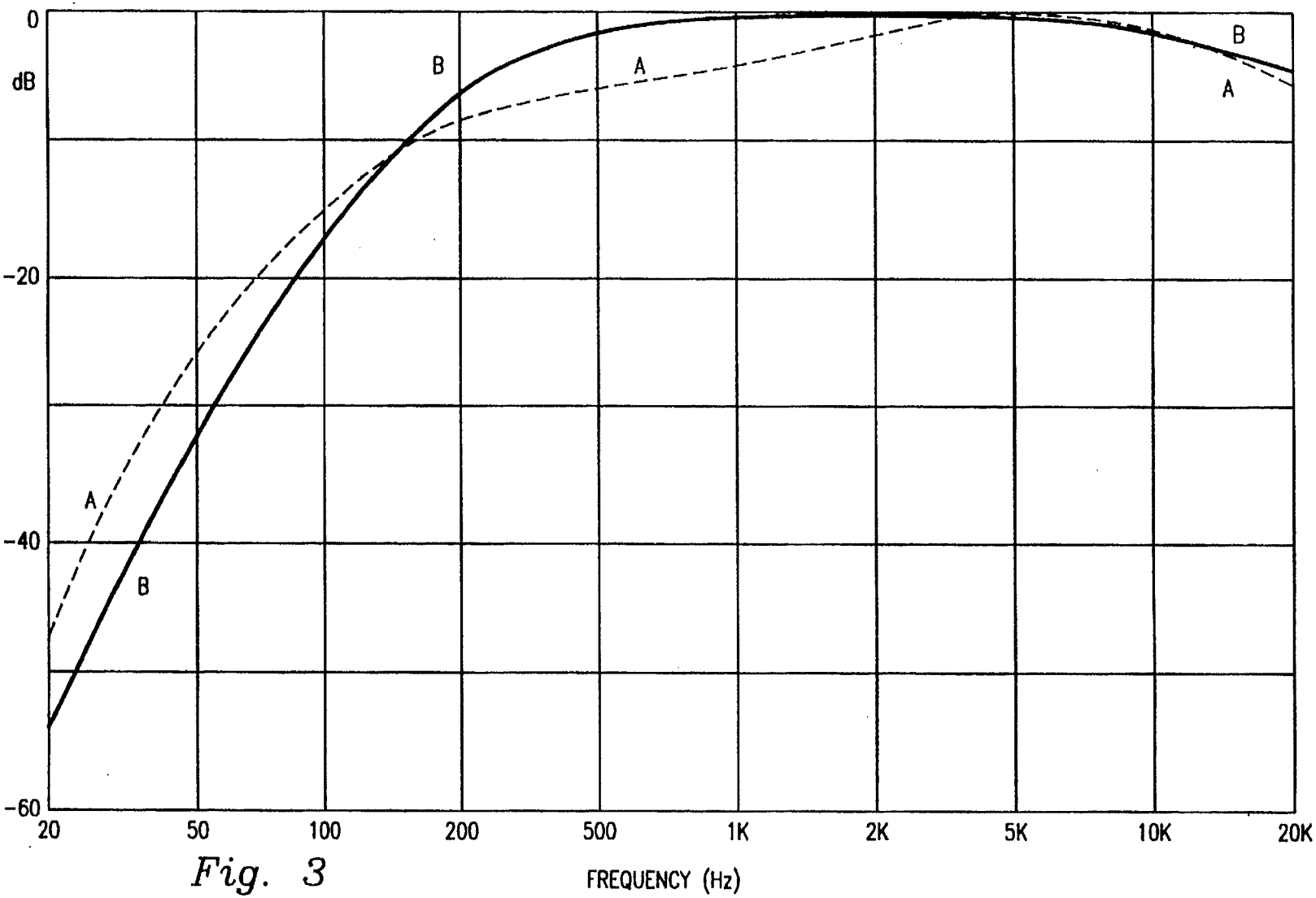
FIG. 3 is a graph of the frequency response of the improved filter also showing the frequency response of the previously used filter for comparison.

Referring to FIG. 3, there is shown a graph of the frequency response of the detector filter of FIG. 2, on which is also shown as a broken curve the corresponding frequency response for the inverse Fletcher-Munson filter of FIG. 4 of copending patent application Ser. No. 08/276,901 for comparison.

It can be seen that the response of the filter of the present invention, labeled B, is about 5 dB more sensitive to midrange audio frequencies than that of the previous filter curve, labeled A. It is also about 5 dB less sensitive to low bass frequencies, minimizing the effects of these frequencies which are not audibly localizable, and therefore detract from correct localization of midrange frequencies if they are allowed to interfere with directional detection.

In FIG. 4 is shown a cancellation matrix forming part of the separation matrix circuit 30. By comparison with FIGS. 10*a*, 10*b*, 11*a* and 11*b* of the copending patent application Ser. No. 08/276,901, it will be seen that the matrix circuit has been considerably simplified. In particular, the gain-riding connections have been eliminated, and the "corner logic kill" switches and resistors have also been removed.

Furthermore, the matrix is configured to operate either in a 4-axis mode or a 6-axis mode. Additionally, not shown in FIGS. 4*a* and 4*b*, the rear channels are configured to operate in Dolby surround/THX mode or in Mono mode for reproduction of monophonic audio.

There are six principal outputs provided by the matrix, as in previous circuitry. In the previous circuitry, the matrixing resistors fed a common virtual ground at the input of an op-amp buffer, before applying the outputs to the level control and output amplifying stages shown in FIG. 1. In the revised circuitry, these buffers are absent, and the matrix resistors each sum into a common point before being applied directly to the volume control circuitry. Either method is equally valid, and the principle of superposition ensures the equivalence of these two approaches to the same end.

In FIG. 4, resistors R401 through R408 sum different proportions of each of eight signals applied to the input terminals labeled LT, –RT, RB, BF, –FT, –LB, –BK and RF, respectively. The common junction of these resistors is the terminal labeled LF 6-AXIS. To determine the effective coefficients, each resistance plays into the total of all the remaining resistors in parallel, so each coefficient is the quotient of the conductance of the corresponding resistor divided by the total conductance of all eight resistors. Thus the coefficient for LT is 0.1 mS divided by 0.6269 mS=0.1595, and so for a left signal, in absence of the other signals (some of which may be present) will produce an output at LF of 0.1595 times the LF input.

It may be convenient to normalize the coefficients to this gain value, by dividing each of the coefficients calculated as in the example above by the value 0.1595, so that the relative coefficients are 1 for LT, the left total input; 0.2551 for –RT, the right total input, which is added here to broaden the sound stage, as discussed in others of the related Patent Applications; 0.6667 for RB, the right back VCA output; 1 for BF, the bass cancellation filter (so that logic control does not affect the low bass frequencies); 0.7519 for –FT, the front VCA negative output, for center front cancellation; 1.1001 for –LB, the left back VCA negative output, for left back cancellation; 1.2407 for –BK, the back VCA negative output, for center back cancellation; and 0.2551 for RF, the right front VCA output, for cancellation of the –RT signal fed to the left front output through R402.

By similar reasoning, the coefficients for each of the remaining sections of FIG. 4 are easily calculated. As the matrix has left-right symmetry, the center front and only one of left or right signal sets need to be calculated.

The inputs to each section of the matrix are, as indicated above, the unmodified left and right total signals LT and RT, and their inversions –LT and –RT; the output of the bass cancellation filter BF, which is derived from the –FT VCA output with an inverting amplifier in the filter; and the six output pairs of the six VCA circuits, LF, RF, LB, RB, FT and BK, with theft inversions –LF, –RF, –LB, –RB, –FT and –BK. These signals will be maximized when their respective VCA control signals LFC, RFC, LBC, RBC, FTC and BKC in FIG. 1 are at their maximum values, respectively.

The output terminals in FIG. 4 are labeled LF 6-AXIS, RF 6-AXIS, LB 6-AXIS, RB 6-AXIS, CF, LB 4-AXIS, RB 4-AXIS, LF 4-AXIS and RF 4-AXIS. For the four corner signals, LF, RF, LB and RB, CMOS analog switches (not shown) select either 4-axis or 6-axis mode of operation, routing either the 4-AXIS or the 6-AXIS signals to the corresponding output gain controls and buffer amplifiers (not shown). The center front matrix is the same in either case and therefore needs no switch.

In FIG. 4, the center front bass cancellation circuit is also shown. At bass frequencies, the resistors R423 and R424 are small in comparison to the impedance of capacitor C401, so that the FT signal is passed through them to the CF output, where it cancels the LT and RT signals applied through resistors R417 and R418. At higher frequencies, the capacitor shunts this signal to ground, thus allowing the LT and RT signals to be combined into the CF output. Note that this circuit simply removes bass from the center front loudspeaker, but it can be disabled by means of the CMOS switch S401, which short-circuits capacitor C401 and therefore removes the bass input frequencies that would otherwise be present, thus allowing a full-range loudspeaker to be used in the center front dialog channel.

FIG. 5 shows the revised control voltage generator circuit. The principal change here is the inclusion of a peak-hold circuit between the logarithmic ratio detectors and the detector splitter circuit. In addition, the front-back and left front-right front output stages of the detector splitter have been modified to add linearity correction, effected by the zener diodes and resistors in their feedback loops, to better match the characteristics of the new VCA circuits to be described below.

Figure 5A:
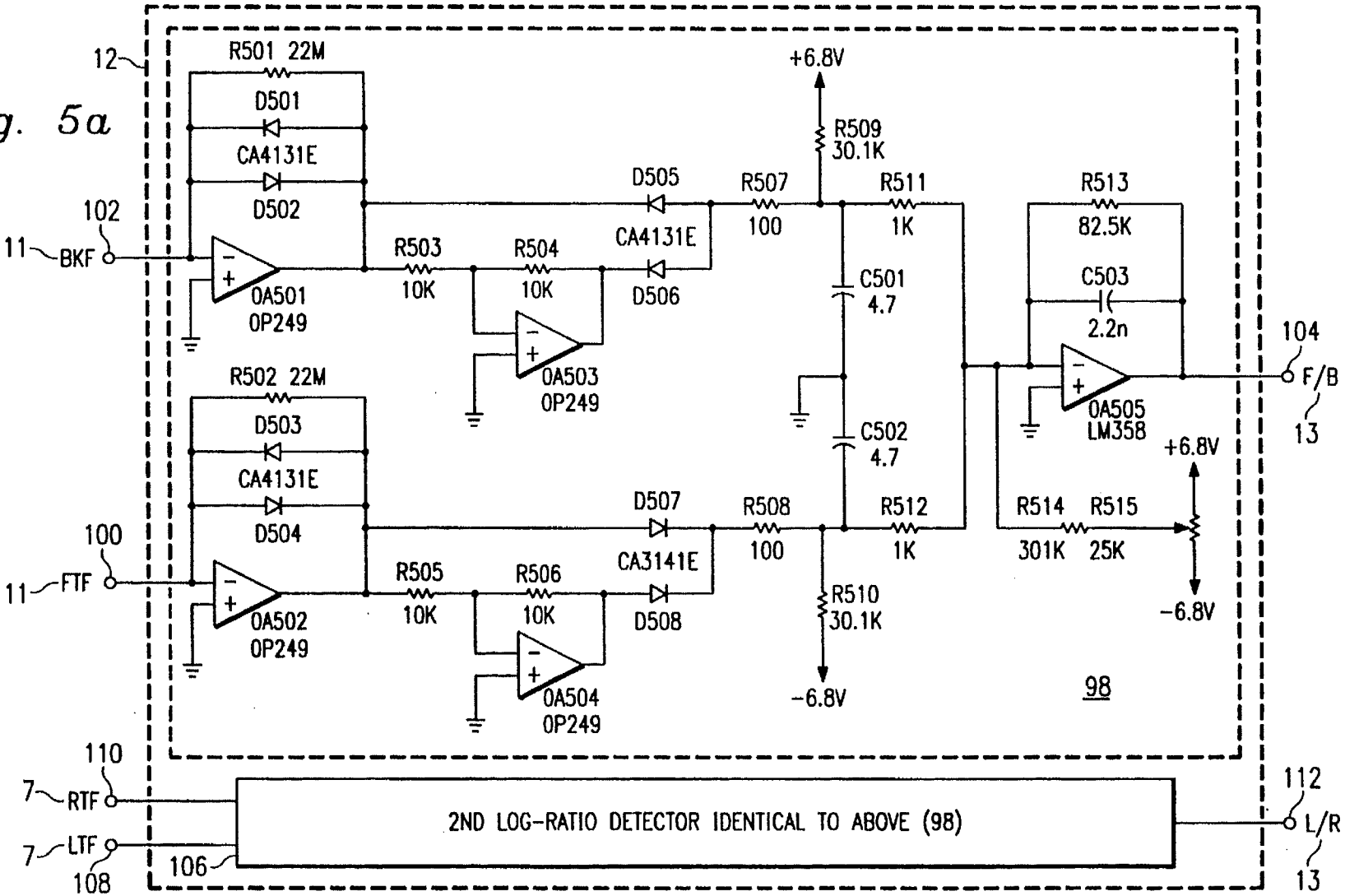
FIG. 5 detailed schematics of the control voltage generator circuitry of the processor of FIG. 1, showing modified component values for improved performance characteristics.

In FIG. 5*a* is shown the detailed schematic of the direction detector circuit 12 which comprises two identical log ratio detector circuits. By comparison with FIG. 5 of the co-pending patent application Ser. No. 08/276,901, the topology is similar, but some important changes have been made. In each of the two input stages, OA501 and OA502 and associated components, a 22 m ohm resistor R501, R502, has been added in parallel with the diodes D404–D404, which limits the dynamic range of the log ratio detector for very small signal levels.

In the previous circuit, capacitors C401 and C402 were placed at the anodes of D405 and D406 and the cathodes of D407 and D408 respectively, to serve as very short term peak detection capacitors; these have been removed from the present circuit.

The values of resistors R507 through R512 are different from their counterparts in the previous circuit, R405 through R410, and capacitors C501 and C502 are 4.7 uF instead of 1 uF (C403 and C404) in the previous circuit. Additionally, the capacitors C405 and C406 and resistors R411 and R412 of the previous circuit have been removed. The effect of these changes is that the detector now has a peak-hold characteristic with an attack time constant of about 0.5 ms and a decay time constant of about 4.7 ms.

In the output amplifier of FIG. 5*a*, the resistor R513 is now about a twelfth of its former value, partly because the resistors in the interstage network have been considerably reduced The zener diodes D409 and D410 in the previous circuit have been removed, and instead, the operational amplifier is connected to reduced supply voltages to limit the output voltage swing.

The components used to trim detector balance, resistor R514 and potentiometer R515, have also been reduced in value from R413 and R415 of the previous circuit.

Although different operational amplifiers have been used in the present circuit, they result in at least some improvement in performance, relative to those of the previous circuitry.

The significant performance advantage of this new detector over the previous circuit is that it responds much faster than before, and it effectively responds to the peaks of the log ratio detector output instead of the average, resulting in higher values of the control signals and hence greater dynamic separation of the different spatially located domponents of the input audio signals.

Figure 5B:
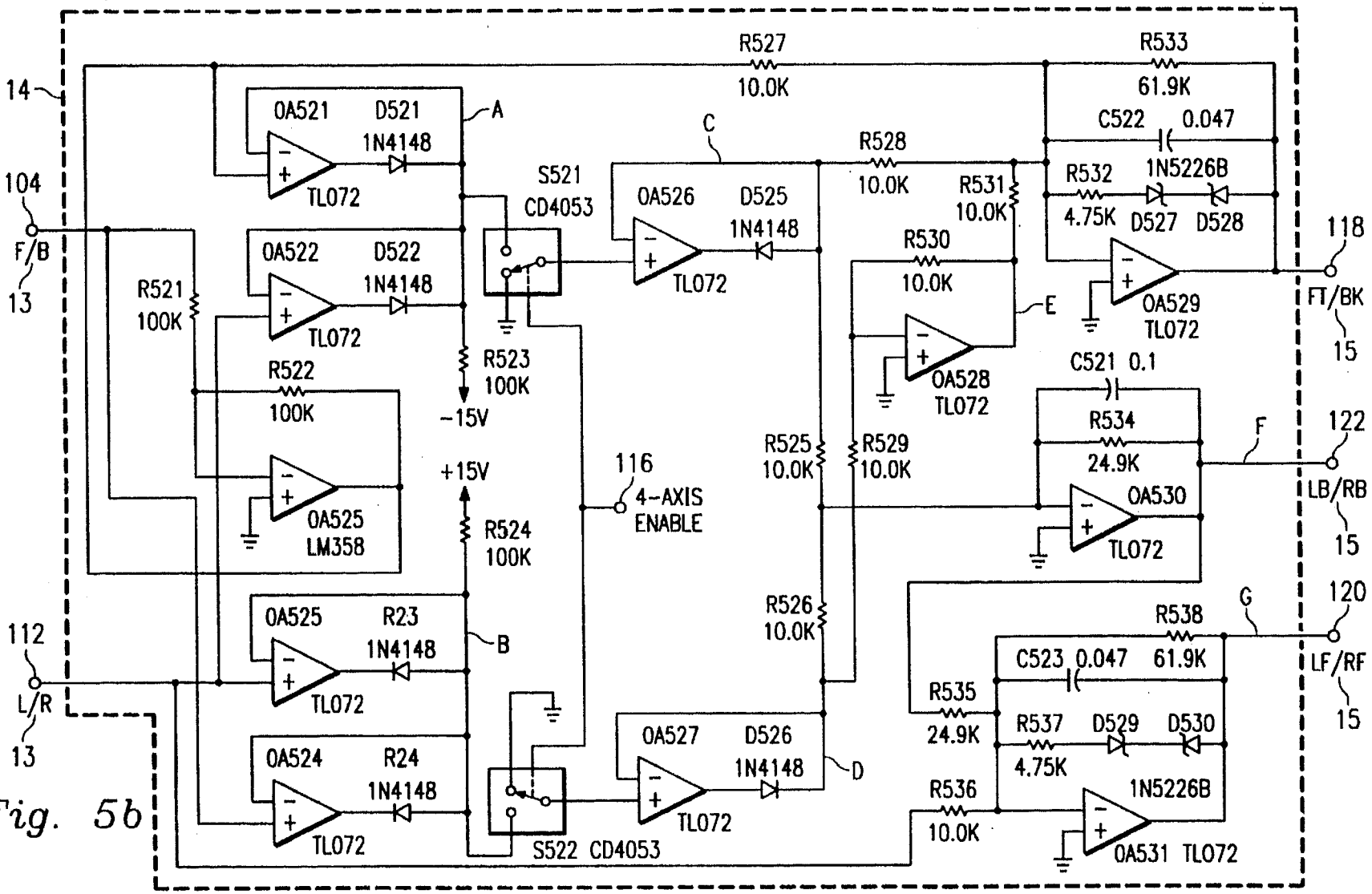
Figure 6:
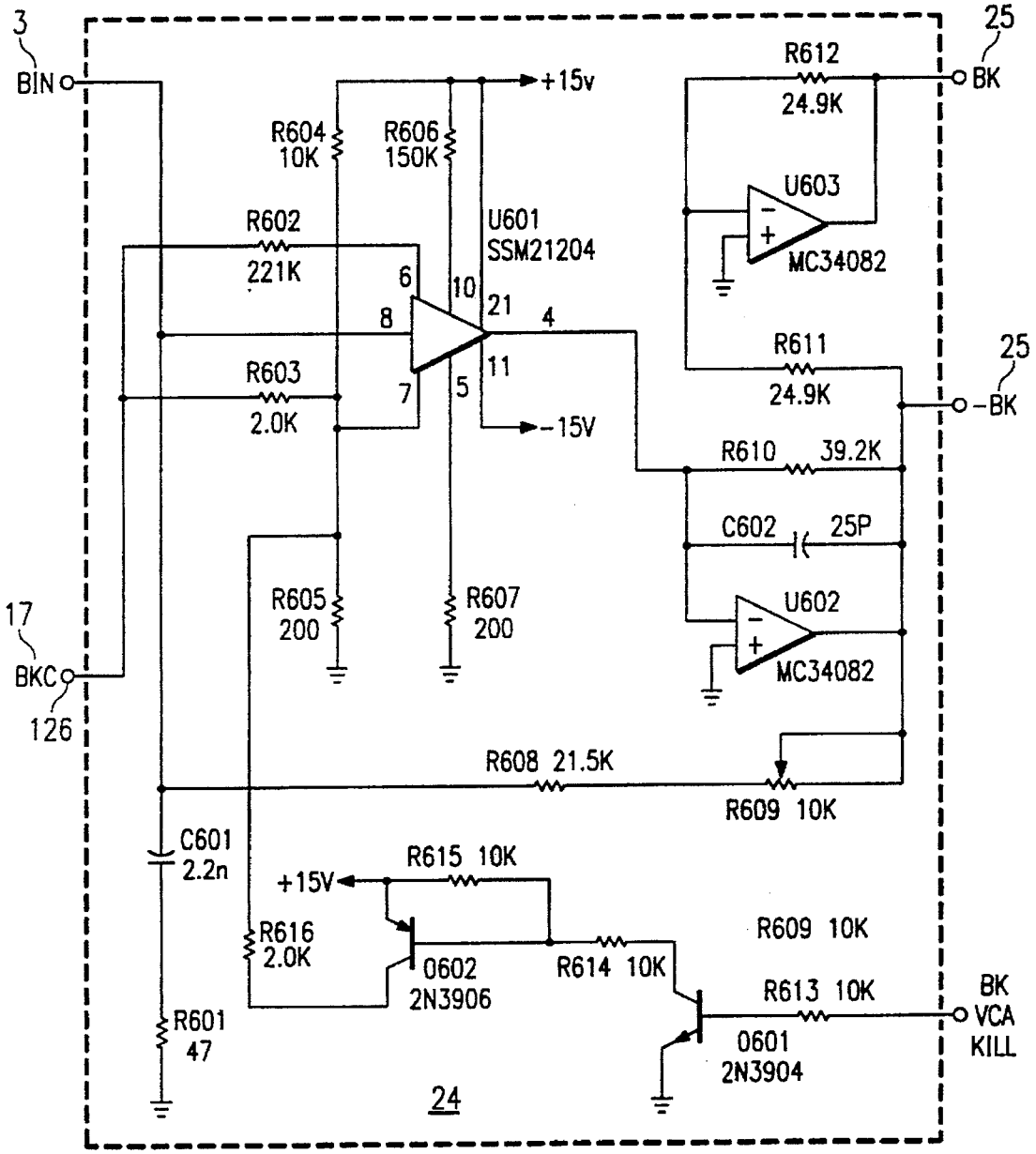
FIG. 6 is a detailed schematic of improved VCA circuitry employed in the processor of FIG. 1.

In FIG. 5*b*, as compared with FIG. 6 of the co-pending application, the alternate modes of operation previously selected byt a switch S505A through S505F is no longer employed, simplifying the circuit considerably.

The CMOS switches S501 and S502 formerly connected so as to "kill" logic action have also been removed from the new circuit. The CMOS switches S503 and S504 connected to kill corner logic while permitting front-back logic to operate have also been removed. Instead, a pair of CMOS switches S521 and S522 have been added to switch between 4-axis and 6-axis modes of operation.

Figure 5C:
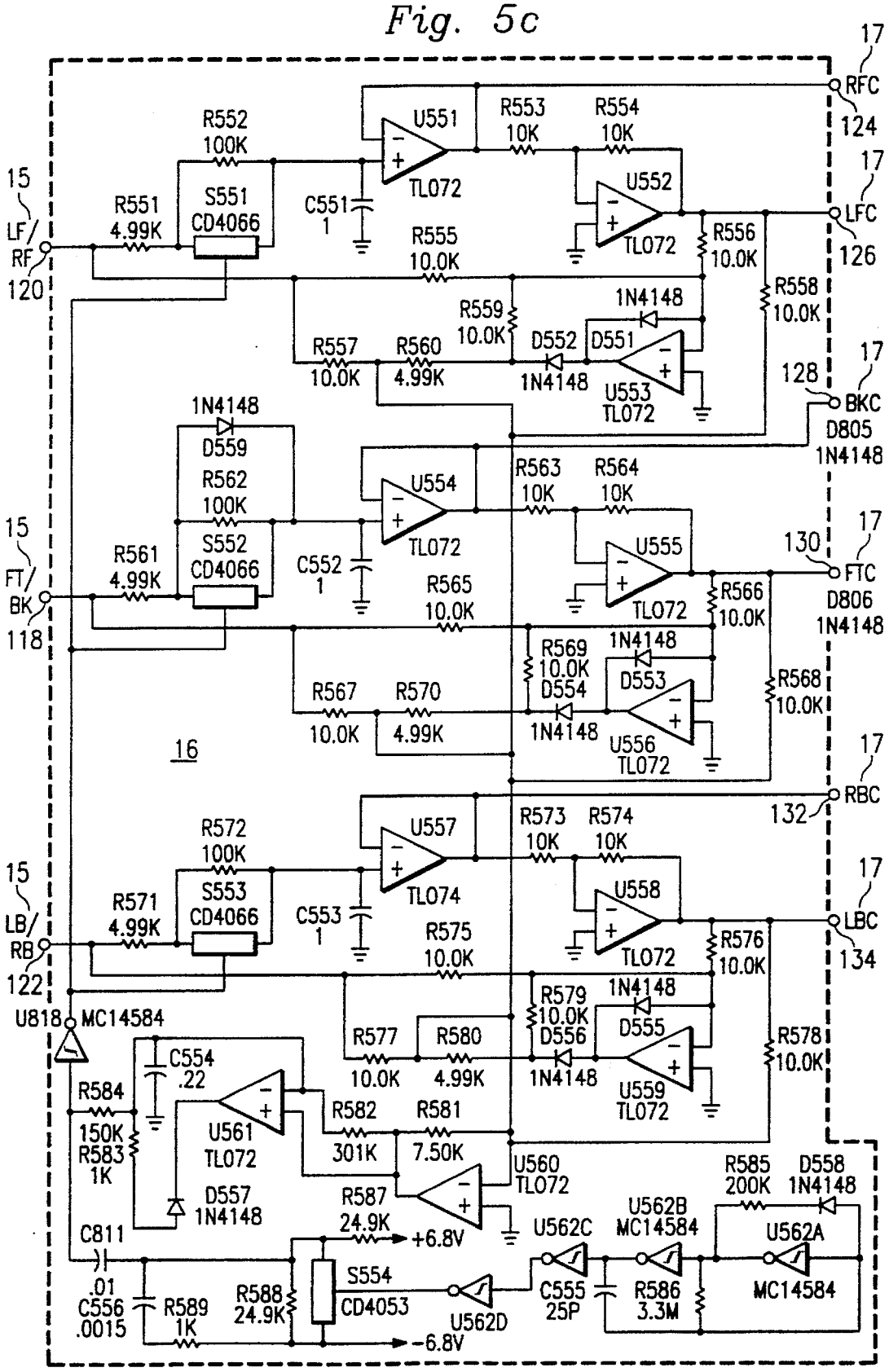

In FIG. 5*c*, which shows a revised servologic circuit comparable to FIG. 8 of the previous application, the revosed VCA's do not require the six operational amplifiers configured as ideal rectifiers that were used in the previous circuit (U803, U804, U808-9, U813-4 of the previous application's FIG. 8). These have been eliminated.

The capacitors C801 etc. following the servologic switches S801-3 in FIG. 8 have been changed in FIG. 5*c* from 0.22 uF to 1 uF, but the following 30 k ohm/0.1 uF networks such as R802 and C802 have been removed. The 3K resistors R801 etc. were changed to 4.99K. The net effect is that a shortest time constant of 5 ms is achieved, the longest being about 28 ms. This range is generally faster than in the previous version of the servologic circuit.

A significant change is the addition of a diode D559 across the servologic switch S552 in the front logic channel. This has the effect of dramatically speeding up the attack time for front channel dialog.

FIG. 6 shows the new VCA circuitry in a representative schematic. All of the VCA's have identical circuitry, except that the back VCA has an added transistor switch circuit to shut off its operation when desired.

The new VCA comprises an integrated circuit U601 of commercially available type SSM612OA, from Analog Devices. The components surrounding this VCA are necessary for its proper operation. The input to this VCA is shown as the signal BIN, which is a combination of LT with –RT in equal proportions, through 49.9 k ohm resistors not shown in FIG. 6. This is the back channel input signal. The output current of U601 drives the virtual ground input of U602, which has resistor R610 in its feedback loop, and capacitor C602 to minimize high frequency noise. This amplifier provides the –BK output to the separation matrix of FIG. 4, while amplifier U603 with resistors R611 and R612 provides the inversion of this signal, i.e. BK, to the separation matrix.

At the lower part of FIG. 6 is shown a transistor switch, comprising transistors Q601-2, with resistors R613-6. When this switch is activated by a logic high on the BK VCA KILL terminal, this VCA is reduced to zero gain. This function is only necessary in some modes of operation of the surround sound processor, and is only required for the center back signal, so the five other VCA's do not include these components.

FIG. 7 shows a schematic representative of the shelf filters provide din the rear channels of the processor. This filter comprises an operational amplifier U701, with input resistor R701, and feedback comprising R702 and the series combination of R703 and C701. The frequency response of the filter is shown in FIG. 8.

The main function of this filter is in reducing sibilant splash into the back channels from front dialog. It also has the effect of increasing the apparent psychoacoustic depth of the sound reproduced in the back channels.

While the embodiments shown herein are representative of the most preferred variations of the circuitry of a surround sound processor according to the present invention, it will be apparent to those silled in the art that many modifications and variations of the circuitry embodiments may be made without departing from the spirit of the present invention.

What is claimed is:

1. A surround sound processor comprising:

audio input terminals for receiving a left and a right audio input signal forming a conventional stereophonic audio signal pair;

an input stage for buffering and balancing said left and right audio input signals and providing output left and right audio signals;

a detector filter circuit receiving the output left and right audio signals and having a band pass characteristic, followed by an inverter circuit and a detector matrix circuit to provide left and right audio signal currents;

a direction detector circuit receiving said left and right audio signal currents and providing therefrom left-right and front-back directional signals, and including peak hold circuitry;

a detector splitter circuit providing left front-right front, left back-right back, and front-back output signals derived from the outputs of said direction detector circuit, and incorporating linearity correction circuitry;

a servologic circuit providing variable time constant smoothing of the output signals from said detector splitter circuit, and producing six output control signals;

voltage controlled amplifier circuits, each controlled by a different one of said six output control signals of said servologic circuit, and each provided with input audio signals that are a combination of said left and right output audio signals from said input stage, each said voltage controlled amplifier circuits being provided with an inverter circuit so as to produce controlled audio signals of both normal and inverted polarity;

a separation matrix circuit for combining the said output left and right audio signals from said input stage with one or more of said output signals from said voltage controlled amplifier circuits in various appropriate proportions so as to provide a plurality of matrix output signals; and a like plurality of output buffer amplifiers for buffering and level control of said matrix output signals to produce at a like plurality of output terminals a set of loudspeaker feed signals for amplification and application to loudspeakers placed in a listening area so as to surround a listener.

2. The processor of claim 1 wherein said detector filter circuit is a band pass filter circuit having an upper cut-off frequency of approximately 15 kHz and a lower cut-off frequency of approximately 330 Hz, with an attenuation of 20 dB/decade below said lower cut-off frequency.

3. The processor of claim 1 wherein said direction detector circuit incorporates a peak hold circuit having an attack time constant of 0.5 ms and a decay time constant of 5 ms.

4. The processor of claim 1 wherein said detector splitter circuit incorporates linearity correction circuitry comprising a combination of a pair of zener diodes connected in series opposition with a series resistor, in parallel with a fixed resistor, the combination thereof being in the feedback path of an operational amplifier to produce reduced gain at higher input signal amplitudes, and similar combinations being incorporated in the feedback path of one or more additional operational amplifiers forming part of said detector splitter circuit.

5. The processor of claim 1 wherein said six voltage controlled amplifier circuits each comprise an integrated voltage controlled amplifier having logarithmic control characteristics; an inverting current to voltage converter; and an inverter.

6. The processor of claim 1 wherein said separation matrix circuit and said detector splitter circuit can be operated either in a six-axis control mode utilizing six of said voltage controlled amplifier circuits, or in a four-axis control mode utilising four of said six voltage controlled amplifier circuits, by disabling said detector splitter circuit.

7. The processor of claim 1 wherein said separation matrix circuit is designed so as to produce cancellation of unwanted signal components in each of said plurality of matrix output signals while not varying the gain of desired components in said matrix output signals.

8. The processor of claim 1 wherein one or more of said plurality of output buffer amplifiers also incorporate shelf filter means having a transfer characteristic approximately −3 dB at 7 kHz and −4.4 dB at 20 kHz.

* * * * *

UNITED STATES PATENT AND TRADEMARK OFFICE

CERTIFICATE OF CORRECTION

PATENT NO. : 5,625,696

DATED : April 29, 1997

INVENTOR(S) : James W. Fosgate

It is certified that error appears in the above-indentified patent and that said Letters Patent is hereby corrected as shown below:

Column 7, line 3, "theft" should be --their--.

Column 10, line 42, "utilising" should be --utilizing--.

Signed and Sealed this

Thirtieth Day of September, 1997

*Attest:*

BRUCE LEHMAN

*Attesting Officer*

*Commissioner of Patents and Trademarks*